US006196909B1

(12) United States Patent
Cadrobbi

(10) Patent No.: US 6,196,909 B1
(45) Date of Patent: Mar. 6, 2001

(54) ABRASING TOOL

(76) Inventor: Paul Cadrobbi, 11511 E. Calle Catalina, Tucson, AZ (US) 85748

( * ) Notice: Subject to any disclaimer, the term of this patent is extended or adjusted under 35 U.S.C. 154(b) by 0 days.

(21) Appl. No.: 09/283,732

(22) Filed: Apr. 1, 1999

(51) Int. Cl.[7] ..... G24D 15/00
(52) U.S. Cl. ..... 451/499; 451/523
(58) Field of Search ..... 451/524, 525, 451/499, 502, 504, 522, 523, 495, 490, 500, 501, 515, 514, 517, 518, 519, 512

(56) References Cited

U.S. PATENT DOCUMENTS

| | | | | |
|---|---|---|---|---|
| 1,844,996 | | 2/1932 | Walker . | |
| 2,275,766 | * | 3/1942 | Johnson | 451/523 |
| 2,413,147 | | 12/1946 | Lawrence . | |
| 2,414,036 | * | 1/1947 | Gerhan | 451/523 |
| 2,457,466 | | 12/1948 | Hanna . | |
| 2,531,588 | * | 11/1950 | Stucker | 451/504 |
| 4,242,843 | | 1/1981 | Phillips . | |
| 4,768,310 | * | 9/1988 | Butts | 451/303 |
| 5,387,251 | | 2/1995 | Rouse . | |

* cited by examiner

*Primary Examiner*—Robert A. Rose
(74) *Attorney, Agent, or Firm*—Schmeiser, Olsen & Watts

(57) ABSTRACT

An abrading tool (10) includes an abrasive belt (11) loosely wrapped around an elongated block (12). A tension adjuster (22) is inserted between the belt (11) and the block (12). The tension in the belt (11) is adjusted by sliding the tension adjuster (22) on the block (12). Alternatively, an abrading tool (40) includes an abrasive sheet (41) wrapped around a base block (42). The two ends of the sheet (41) are disposed in a slot (52) on the base block (42). A mounting block (62) tightly fits into the slot (52) to secure the abrasive sheet (41) to the base block (42).

17 Claims, 3 Drawing Sheets

Fig. 1

ABRASING TOOL

FIELD OF THE INVENTION

The present invention relates, in general, to abrading tools and, more particularly, to abrading tools that use replaceable abrasive belts or sheets.

BACKGROUND OF THE INVENTION

Various abrading tools using abrasive belts or abrasive sheets are known. Many of these tools are power operated. A typical power operated abrading tool has an abrasive belt or an abrasive sheet secured thereon and performs the abrading function by vibration or rotation. While such power tools are useful for many purposes, there has always been the need for good hand operated abrading tools. A good hand operated tool should be simple and easy to use. However, many hand operated abrading tool available on the market are not configured to accomplish the type of fine abrasion that is required in some applications.

A basic description of such tools is best accomplished by reviewing a number of patents issued in this area.

U.S. Pat. No. 2,457,466 (Hanna) discloses a hand operated abrader having a supporting block and a sharply curved push bar. One end of the supporting block has a flat portion. An abrasive strip in continuous form envelops the supporting block. The push bar has a pair of arms disposed in two holes in the flat portion of the supporting block. A coil spring loosely surrounds each of the arms and has one end seated against the shoulder in the appropriate hole and the other end active against the push bar, thereby holding the abrasive strip to the supporting block.

U.S. Pat. No. 4,242,843 (Phillips) discloses an abrading tool having an endless abrasive belt wrapped around an elongated block that has a wedge cavity at one end. A wedge is inserted into the wedge cavity to apply tension on the abrasive belt and secure the abrasive belt to the elongated block.

U.S. Pat. No. 1,844,998 (Walker) discloses an abrading sheet holder having a major section and a substantially flat tongue section. The major section has a broad shallow channel. A slot on one side of the channel receives one end of an abrading sheet. The other end of the abrading sheet is disposed in a slot on the tongue section. A concave pocket extends throughout the length of the channel opposite to the slot in the channel. A rounded side edge opposite to the slot in the tongue section fits into the concave pocket in the channel. Dowel pins connects the tongue section to the major section near the slots.

U.S. Pat. No. 2,413,147 (Lawrence) discloses a hand sander having a body portion and a wedge block. Two ends of a sanding strip are positioned in two slots on the body portion, one slot in one end of the body portion and the other slot in the upper surface of the body portion. The intermediate portion of the sanding strip is stretched over the lower surface of the body portion. The wedge block fits into the slot in the upper surface of the body portion, securing the sanding strip to the body portion.

A problem with these and other prior art abrading tools is that it is not very easy to remove and replace abrasive belts or abrasive sheets. In addition, they are complicated and, therefore, not very cost efficient.

Accordingly, it would be advantageous to have abrading tools using abrasive sheets or endless abrasive belts that are simple and cost efficient. It is desirable for the abrading tools to allow simple and easy adjustment of the tensions in the abrasive sheets or belts. It is also desirable if the abrasive sheets of belts can be easily removed and replaced. Furthermore, where a significant amount of abrading is required, the comfortable use of the tools and excellent control of the tools are also important desirable factors.

SUMMARY OF THE INVENTION

A prime object of the present invention is to provide a simple, effective, and cost efficient abrading tool. A further object is to provide the tool that is easy and convenient to use. A further object is to provide the tool wherein the abrasive belts or sheets can be effectively and efficiently used. A further object is to provide the tool wherein the worn abrasive belts or sheets can be easily and quickly removed and replaced. In addition, it is an object of the present invention to provide the tool capable of abrading surfaces of various sizes and shapes.

In accordance with one embodiment of the present invention, the abrading tool includes an abrasive belt loosely wrapped around an elongated block. A tension adjuster is inserted between the belt and the block. When the tension adjuster is moved toward an end of the object, the belt becomes taut. The belt can be rotated around the block or removed from the block by sliding the tension adjuster toward the center of the block, thereby reducing the tension in the belt.

In accordance with another embodiment of the present invention, the abrading tool includes an abrasive sheet wrapped around a base block. The two ends of the sheet are disposed in a slot on the base block. A mounting block tightly fits into the slot to secure the abrasive sheet to the base block. Except for a small portion disposed in the slot, the whole surface area of the sheet can be used for abrading. The mounting block can also function as a guide when the abrading tool is used for abrading an edge of a surface. The sheet can be removed and replaced by taking the mounting block away from the slot on the base block.

DETAILED DESCRIPTION OF THE PREFERRED EMBODIMENTS

Figure 1:
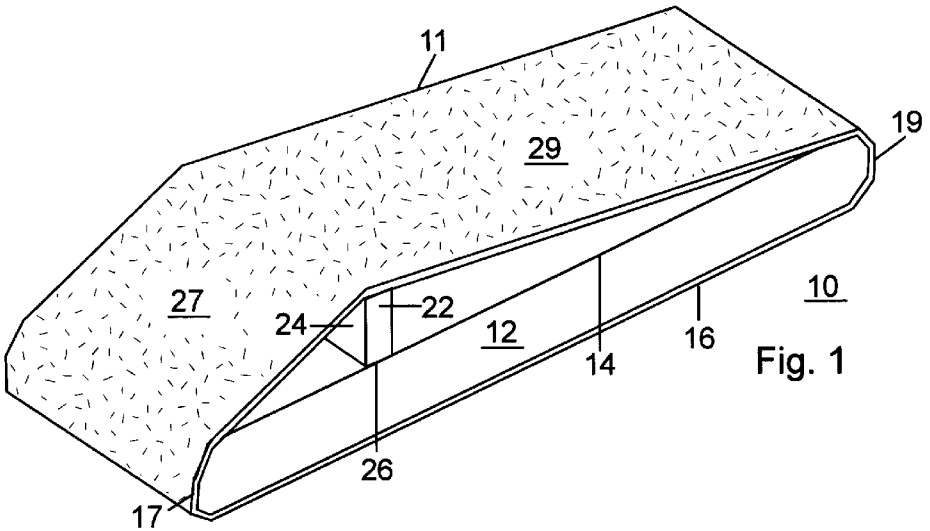
FIGS. 1 and 2 are schematic diagrams illustrating an abrading tool in accordance with a first embodiment of the present invention.

Various embodiments of the present invention are described herein below with reference to the figures. It should be noted that the figures are not necessarily drawn to scale and that elements having similar functions are labeled using the same reference numerals in the figures.

Figure 2:
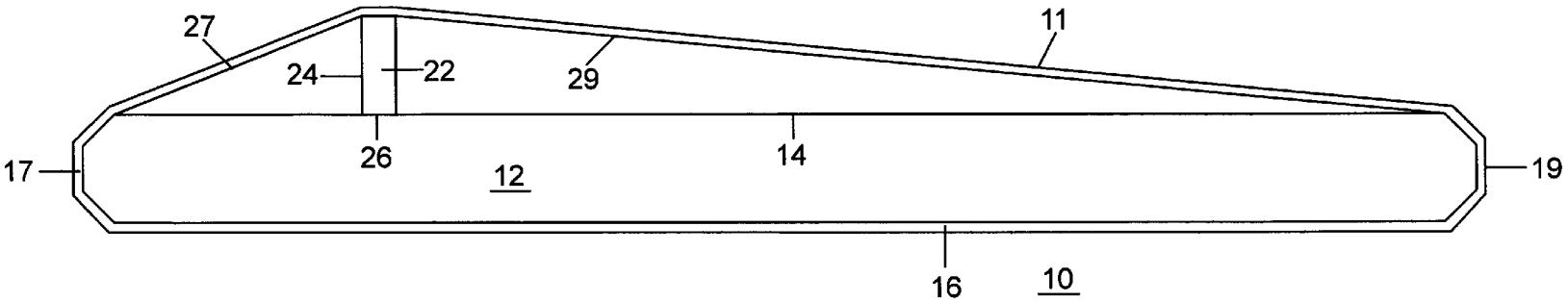

FIGS. 1 and 2 are an isometric view and a side view, respectively, of an abrading tool 10 in accordance with a first embodiment of the present invention. Abrading tool 10 is a hand operated tool and is sometimes also referred to as an abrading block, an abrader, a sanding tool, a sanding block, or a sander. Abrading tool 10 includes an endless abrasive belt 11 wrapped around an elongated block 12 and a tension adjuster 22 inserted there between. Abrasive belt 11 can be made of sand paper, emery cloth, or other types of abrading materials. Block 12 and tension adjuster 22 can be made of wood, plastic, metal, or other reasonably hard materials. Block 12 and tension adjuster 22 are collectively referred to as a holder for holding abrasive belt 11.

Elongated block 12 has a top major surface 14 and a bottom major surface 16 opposite to each other. Two ends, a front end 17 and a back end 19, of block 12 are opposite to each other and coupled between top major surface 14 and bottom major surface 16. FIGS. 1 and 2 show that top surface 14 and bottom surface 16 are substantially flat elongated surfaces and ends 17 and 19 have beveled edges. Preferably, block 12 is approximately as wide as abrasive belt 11. A typical width of abrasive belt 11 widely available on the market is approximately 76 millimeters (mm). The length of block 12 depends on the circumference of abrasive belt 11. In one example, block 12 is approximately 250 mm long and approximately 20 mm thick and suitable for receiving an abrasive belt having a circumference of approximately 530 mm. In another example, block 12 is approximately 287 mm long and approximately 20 mm thick and suitable for receiving an abrasive belt having a circumference of approximately 610 mm.

Tension adjuster 22 is small block having a rectangular cross section. A dimension along the long side, referred to as a side 24, of the rectangular cross section is referred to as a height of tension adjuster 22. A dimension along the short side, referred to as a side 26, of the rectangular cross section is referred to as a width of tension adjuster 22. A dimension along a direction substantially perpendicular to the rectangular cross section is referred to as a length of tension adjuster 22. Tension adjuster 22 is preferably so shaped that its length is approximately equal to the width of block 12 and its height is greater than its width. In a preferred embodiment, the height and width of tension block 22 are approximately 20 mm and approximately 10 mm, respectively.

Abrading tool 10 is assembled together by placing abrasive belt 11 over elongated block 12 so that it is loosely wrapped around top surface 14, end 17, bottom surface 16, and end 19 of block 12. The abrasive side of abrasive belt 11 is facing away from block 12. Tension adjuster 22 is inserted between top surface 14 of block 12 and the back side of abrasive belt 11. For easy insertion, tension adjuster 22 can be inserted near the center of to surface 14. After being inserted, tension adjuster 22 is moved toward an end, e.g., front end 17, of block 12 until abrasive belt 11 wrapped around block 12 becomes taut.

When abrading tool 10 is assembled, tension adjuster 22 suspends a portion of abrasive belt 11 above front surface 14 of block 12. A section 27 of abrasive belt 11 is located between front end 17 of block 12 and tension adjuster 22. Another section 29 of abrasive belt 11 is located between back end 19 of block 12 and tension adjuster 22. Sections 27 and 29 are aslant with respect to front surface 14. In other words, sections 27 and 29 form two slanted surfaces suspended over block 12. When using abrading tool 10, an operator can place his palm on either section 27 or section 29 and push abrading tool 10 forward by pressing on the corresponding slanted surface. The slanted surfaces also function as soft cushions between the operator's hand and block 12. By placing his/her hand on either of slanted section 27 or slanted section 29, an operator can extend his/her fingers over tension adjuster 22. This enables the operator to obtain a good grip of abrading tool 10 and aids greatly when pushing and pulling abrading tool over the surface being abraded. Because sections 27 and 29 are slanted, the pressure by the operator urges abrading tool to slide over the abraded surface.

The tension in abrasive belt 11 can be conveniently adjusted by sliding tension adjuster 22 on front surface 14 of block 12. The tension in abrasive belt 11 increases when tension adjuster 22 moves toward either end of block 12 and decreases when tension adjuster 22 moves toward the center on top surface 14 of block 12. In addition, the tension in abrasive belt 11 can also be adjusted by changing the orientation of tension adjuster 22. For example, the tension in abrasive belt 11 is greater when tension adjuster 22 is in an upright position with side 24 substantially perpendicular to top surface 14 than when tension adjuster 22 is in a lie down position with side 24 substantially parallel to top surface 14.

When a portion of abrasive belt 11 is worn out, abrasive belt 11 can be rotated on block 12 to move a fresh portion to the desirable abrading position, e.g., a position adjacent bottom surface 16 of block 12. This can be easily accomplished by sliding tension adjuster 22 toward the center of block 12 to reduce the tension in abrasive belt 11, rotating abrasive belt 11, and sliding tension adjuster 22 toward an end of block 12 to readjust the tension in abrasive belt 11. Abrasive belt 11 can be easily removed from block 12 by sliding tension adjuster 22 toward the center of block 12 to reduce the tension in abrasive belt 11 and separating abrasive belt 11 and block 12 from each other.

It should be understood that the structure of abrading tool 10 is not limited to being that described herein above and shown in FIGS. 1 and 2. For example, ends 17 and 19 are not limited to being beveled. They can be flat or convex. In the case of being flat, ends 17 and 19 can be either perpendicular or oblique to top surface 14. In the case of being convex, ends 17 and 19 can have either the same or different curvatures. Bottom surface 16 is not limited to being parallel to top surface 14 or being substantially planar. Bottom surface 16 can have different orientations and/or shapes for different preferences of the operator. The cross section of tension adjuster 22 is not limited to being rectangular. For example, the tension adjuster 22 can have a cross section that is a triangle, square, trapezium, pentagon, hexagon, etc. Further, elongated block 12 and tension adjuster 22 are not limited to being solid blocks. They can have slots or cavities formed therein to reduce the weight and/or material usage.

Figure 3:
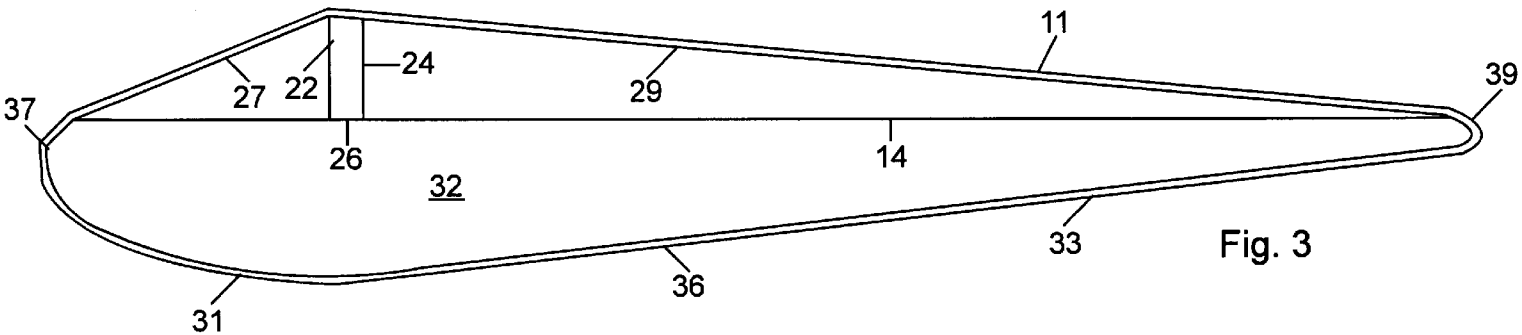
FIG. 3 is a schematic diagram illustrating an abrading tool in accordance with a second embodiment of the present invention.

FIG. 3 schematically illustrates a side view of an abrading tool 30 in accordance with a second embodiment of the present invention. Abrading tool 30 is a hand operated tool and is sometimes also referred to as an abrading block, an abrader, a sanding tool, a sanding block, or a sander. Abrading tool 30 includes an endless abrasive belt 11 wrapped around an elongated block 32 and a tension adjuster 22 inserted there between. Elongated block 32 and tension adjuster 22 are collectively referred to as a holder for holding abrasive belt 11. Abrading tool 30 is structurally similar to abrading tool 10 shown in FIGS. 1 and 2.

A difference between abrading tools 10 and 30 is that the shape of elongated block 32 in abrading tool 30 is different from that of elongated block 12 in abrading tool 10. Like elongated block 12 in abrading tool 10, elongated block 32 in abrading tool 30 has two major surfaces, a top surface 14 and a bottom surface 36. Unlike bottom surface 16 in block 12, bottom surface 36 in block 32 is curved. More particularly, bottom surface 36 has a convex front portion 31 and a substantially planar back portion 33 that is oblique with respect to top surface 14. Convex front portion 31 of bottom surface 36 intersects with top surface 14 at a front end 37 of block 32. Planar back portion 33 of bottom surface 36 intersects with top surface 14 at a back end 39 of block 32.

The processes of assembling, adjusting, and operating abrading tool 30 are substantially the same as the corresponding processes of assembling, adjusting, and operating abrading tool 10 shown in FIGS. 1 and 2. The different shapes of elongated blocks 12 and 32 are adapted for different applications of abrading tools 10 and 30 and/or for different preferences of the operators.

Figure 4:
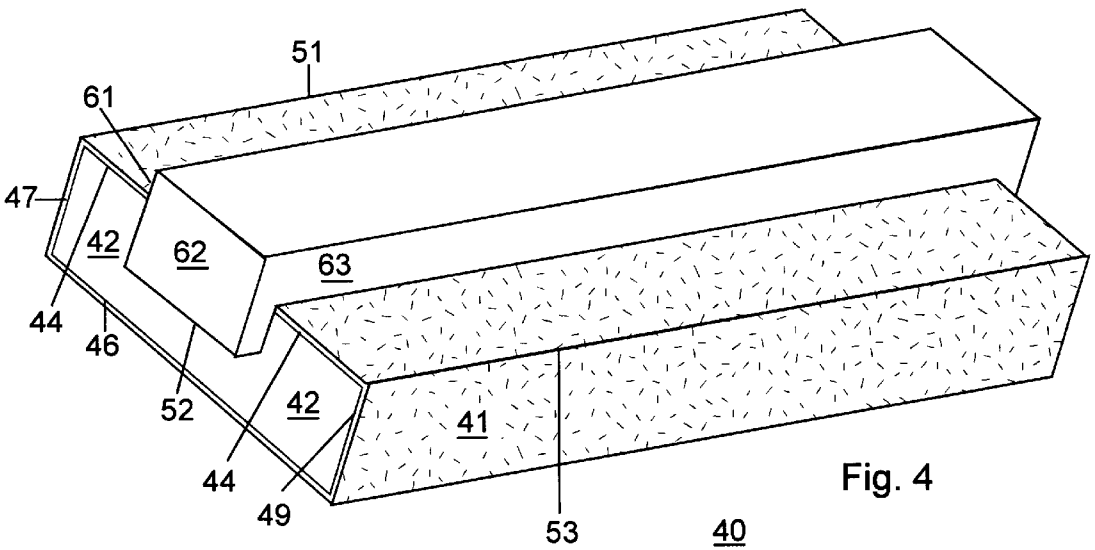
FIGS. 4 and 5 are schematic diagrams illustrating an abrading tool in accordance with a third embodiment of the present invention.
Figure 5:
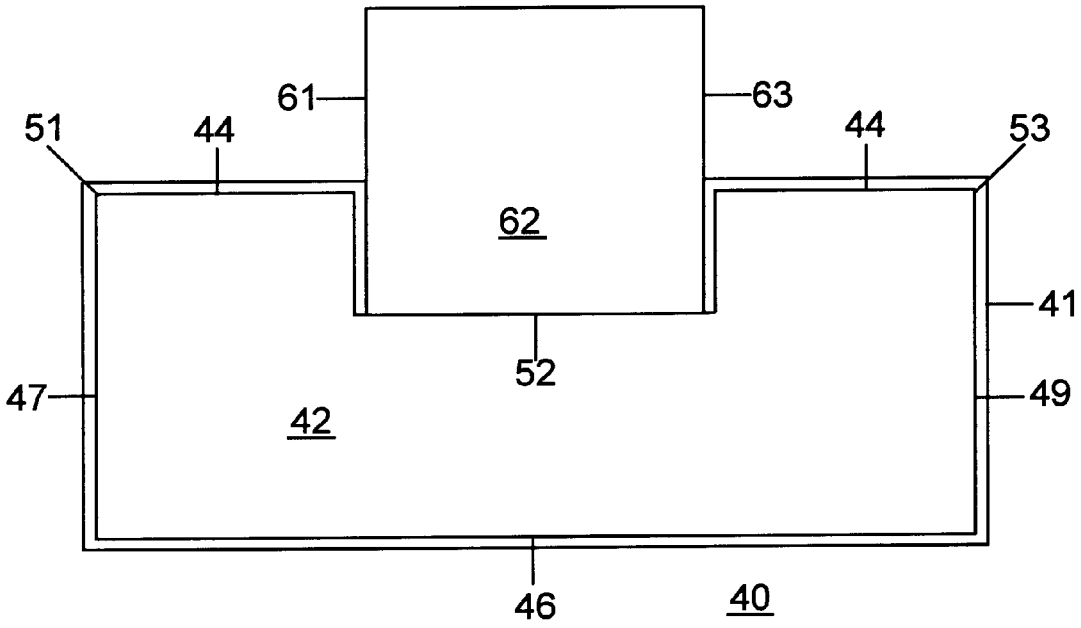

FIGS. 4 and 5 are an isometric view and a front view, respectively, of an abrading tool 40 in accordance with a third embodiment of the present invention. Abrading tool 40 is a hand operated tool and is sometimes also referred to as an abrading block, an abrader, a sanding tool, a sanding block, or a sander. Abrading tool 40 includes a base block 42 and a mounting block 62 that secures an abrasive strip or sheet 41 to base block 42. Abrasive sheet 41 can be made of sand paper, emery cloth, or other types of abrading materials.

Base block 42 and mounting block 62 can be made of wood, plastic, metal, or other reasonably hard materials. Base block 42 and mounting block 62 are collectively referred to as a holder for holding abrasive sheet 41.

Base block 42 has two major surfaces, a top surface 44 and a bottom surface 46 opposite to each other, and two end surfaces, an end surface 47 and an end surface 49, opposite to each other and coupled between top surface 44 and bottom surface 46. Top surface 44 and bottom surface 46 are substantially flat and substantially parallel to each other. End surface 47 and end surface 49 are substantially perpendicular to top surface 44 and intersect therewith at an edge 51 and an edge 53, respectively, of top surface 44. A slot 52 is formed in top surface 44 between edges 51 and 53. Slot 52 extends throughout the length of base block 42. Mounting block 62 is adapted for removably but tightly fitting into slot 52 in base block 42. When disposed in slot 52, mounting block 62 has a portion protruding over top surface 44 of base block 42. The protruding portion of mounting block 62 has two sides, a side 61 adjacent edge 51 and a side 63 adjacent edge 53. Sides 61 and 63 are substantially perpendicular to top surface 44 of base block 42. Sides 61 and 63 are further substantially parallel to edges 51 and 53 of top surface 44 of base block 42. The actual dimensions of base block 42 depend on the size of abrasive sheet 41. In a preferred embodiment, base block 42 is approximately 115 mm in length, approximately 50 mm in width, and approximately 20 mm in height. In the embodiment, slot 52 is approximately 6 mm deep and approximately 12 mm wide, and mounting block 62 is approximately 12 mm in height.

Abrading tool 40 is assembled together by stretching abrasive sheet 41 over bottom surface 46 of base block 42 and wrapping two ends of abrasive sheet 11 around end surfaces 47 and 49. The two ends of abrasive sheet 41 are then positioned in slot 52. Mounting block 62 is fitted into slot 52 and catching the two ends of abrasive sheet 41 between mounting block 62 and the slot 52. Mounting block 62 frictionally secures the two ends of abrasive sheet 41 to base block 42.

Abrading tool 40 can be quickly and easily disassembled by taking mounting block 62 away from base block 42 and separating abrasive sheet 41 and base block 42 from each other.

After abrading tool 40 is assembled, the portions of abrasive sheet 41 stretched over bottom surface 46, end surface 47, and end surface 49 can all be used in an abrading process. Further, the portions of abrasive sheet 41 over top surface 44 between side 61 of mounting block 62 and edge 51 and between side 63 of mount block 62 and edge 53 can also be used in the abrading process. The only portions of abrasive sheet 41 that cannot be used for abrading are the small portions near the two ends of abrasive sheet 41 caught between mounting block 62 and slot 52 of base block 42. A unique feature of abrading tool 40 is that sides 61 and 63 of mounting block 62 can function as guides for abrading a surface near its edge. By way of example, an operator can press the portion of abrasive sheet 41 over top surface 44 between side 61 of mounting block 62 and edge 51 on the surface to be abraded and press side 61 of mounting block 62 against the edge of the surface. Then, side 61 of mounting block 62 serves as a guide when abrading tool 40 is pushed back and forth along the edge of the surface to be abraded.

It should be understood that the structure of abrading tool 40 is not limited to being that described herein above and shown in FIGS. 4 and 5. For example, end surfaces 47 and 49 are not limited to being flat. They can be beveled or curved. In the case of being curved, end surfaces 47 and 49 can have either the same or different curvatures. If end surfaces 47 and 49 are flat, they can be either perpendicular or oblique to top surface 44. Bottom surface 46 is not limited to being parallel to top surface 44 or being substantially planar. Bottom surface 46 can have different orientations and/or shapes for different preferences of the operator. Edges 51 and 53 of top surface 44 are not limited to being parallel to each other. Further, they are not limited to being straight lines. Mounting block 62 can have different shapes from that shown in FIGS. 4 and 5. For example, sides 61 and 63 can be oblique with respect to top surface 44 of base block 42. Optionally, mounting block 62 can include a knob on its top. The operator can hold the knob during the abrading process. In addition, base block 42 and mounting block 62 are not limited to being solid blocks. They can have slots or cavities formed therein to reduce the weight and/or material usage.

Figure 6:
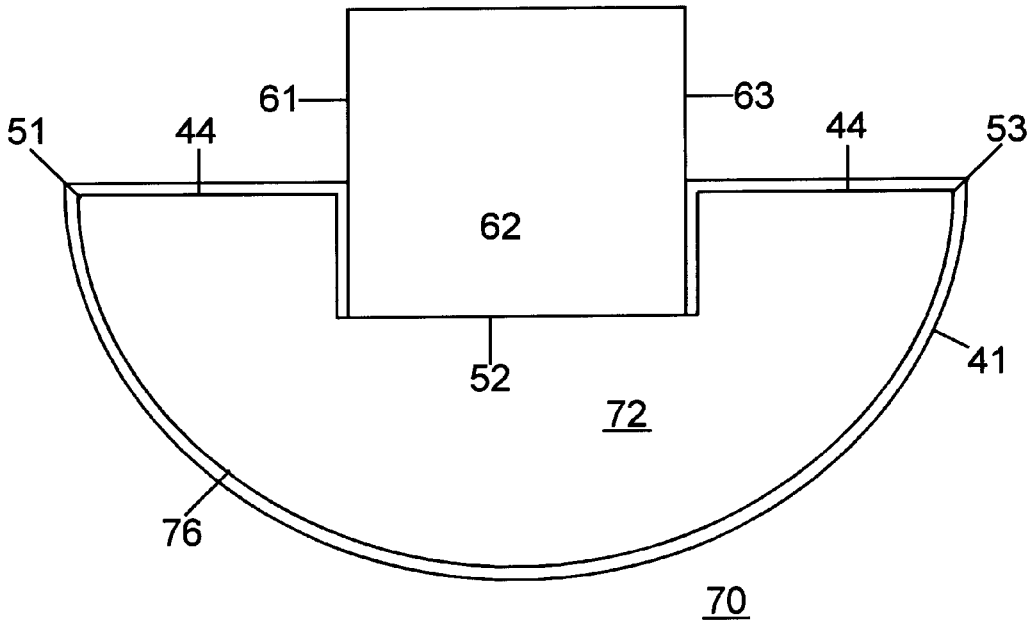
FIG. 6 is a schematic diagram illustrating an abrading tool in accordance with a fourth embodiment of the present invention.

FIG. 6 schematically illustrates a front view of an abrading tool 70 in accordance with a fourth embodiment of the present invention. Abrading tool 70 is a hand operated tool and is sometimes also referred to as an abrading block, an abrader, a sanding tool, a sanding block, or a sander. Abrading tool 70 is structurally similar to abrading tool 40 shown in FIGS. 4 and 5. Abrading tool 70 includes a base block 72 and a mounting block 62 for securing an abrasive strip or sheet 41 to base block 72. Base block 72 and mounting block 62 are collectively referred to as a holder for holding abrasive sheet 41.

A difference between abrading tools 40 and 70 is that the shape of base block 72 in abrading tool 70 is different from that of base block 42 in abrading tool 40. Base block 72 has two major surfaces, a top surface 44 and a bottom surface 76 opposite to each other. Unlike bottom surface 46 in base block 42 shown in FIGS. 4 and 5, bottom surface 76 is curved. More particularly, bottom surface 76 is convex and intersects with top surface 44 at edges 51 and 53 of top surface 44. Consequently, abrading tool 70 does not have end surfaces corresponding to end surfaces 47 and 49 of base block 42 shown in FIGS. 4 and 5.

The processes of assembling, adjusting, and operating abrading tool 70 are substantially the same as the corresponding processes of assembling, adjusting, and operating abrading tool 40 shown in FIGS. 4 and 5. The different shapes of base blocks 42 and 72 are adapted for different applications of abrading tools 40 and 70 and/or for different preferences of the operators.

By now it should be appreciated that several simple, effective, and cost efficient abrading tools have been provided. The abrading tools of the present invention are easy and convenient to use. The abrasive belts or sheets in the abrading tools of the present invention can be effectively and efficiently used. Worn abrasive belts or sheets can be easily and quickly removed and replaced. In addition, The abrading tools of the present invention are capable of abrading surfaces of various sizes and shapes.

What is claimed is:

1. An abrading tool, comprising:

a block having a first surface, a second surface opposite to the first surface, a first end between the first surface and the second surface, a second end between the first surface and the second surface and opposite to the first end, and a longitudinal axis extending between the first end and the second end;

an abrasive belt wrapped around said block; and a tension adjuster inserted between the first surface of said block and said abrasive belt, wherein said tension adjuster abuts said first surface of said block and wherein said tension adjuster abuts said abrasive belt, said tension adjuster adjusting a tension in said abrasive belt by the entire tension adjuster sliding along said longitudinal axis on the first surface of said block, wherein said tension adjuster continuously adjusts said tension in said abrasive belt by continuously sliding on the first surface of said block.

2. The abrading tool of claim 1, wherein the second surface of said block is substantially flat.

3. The abrading tool of claim 1, wherein the second surface of said block is curved.

4. The abrading tool of claim 1, wherein:

said tension adjuster has a first side and a second side substantially perpendicular to the first side; and said tension adjuster has a first dimension along the first side and a second dimension along the second side, the first dimension being greater than the second dimension.

5. The abrading tool of claim 4, wherein the tension in said abrasive belt is greater when the first side of said tension adjuster is substantially perpendicular to the first surface of said block than the tension in said abrasive belt when the first side of said tension adjuster is substantially parallel to the first surface of said block.

6. The abrading tool of claim 1, wherein said tension adjuster suspends a portion of said abrasive belt above the first surface of said block.

7. The abrading tool of claim 6, wherein a first section of said abrasive belt located between the first end of said block and said tension adjuster and a second section of said abrasive belt located between the second end of said block and said tension adjuster are aslant with respect to the first surface of said block.

8. A holder for an abrasive belt, comprising:

an elongated block having a first major surface, a second major surface opposite to the first major surface, a first end coupled between the first major surface and the second major surface, and a second end coupled between the first major surface and the second major surface and opposite to the first end;

a tension adjuster inserted between the first major surface of said elongated block and the abrasive belt when the abrasive belt is wrapped around the first major surface, the first end, the second major surface, and the second end of said elongated block, wherein the tension adjuster abuts the first major surface and the abrasive belt, wherein a first section of the abrasive belt is freely suspended above the first major surface between the tension adjuster and the first end, and wherein a second section of the abrasive belt is freely suspended above the first major surface between the tension adjuster and the second end; and wherein a tension in the abrasive belt is continuously increased by continuously moving said tension adjuster between the first major surface of said elongated block and the abrasive belt toward one of the first end and the second end of said elongated block.

9. The holder of claim 8, wherein said tension adjuster pushes the abrasive belt away from the first major surface of said elongated block.

10. The holder of claim 9, wherein said first section of the abrasive belt located between the first end of said elongated block and said tension adjuster forms a slanted surface with respect to the first major surface of said elongated block.

11. The holder of claim 8, wherein the first major surface of said elongated block is substantially flat.

12. The holder of claim 8, wherein the second major surface of said elongated block is substantially flat.

13. The holder of claim 8, wherein the second major surface of said elongated block is curved.

14. An abrading tool, comprising:

a block having a first surface, a second surface opposite to the first surface, a first end between the first surface and the second surface, and a second end between the first surface and the second surface and opposite to the first end;

an abrasive belt wrapped around said block; and at least one tension adjuster inserted between the first surface of said block and said abrasive belt, said tension adjuster adjusting a tension in said abrasive belt by sliding on the first surface of said block, wherein a first section of the abrasive belt is freely suspended above the first surface between the tension adjuster and the first end.

15. The abrading tool of claim 14, wherein the tension in said abrasive belt increases as said tension adjuster slides toward one of the first end and the second end of said block.

16. The abrading tool of claim 14, wherein:

said tension adjuster has a first side and a second side substantially perpendicular to the first side; and said tension adjuster has a first dimension along the first side and a second dimension along the second side, the first dimension being greater than the second dimension.

17. The abrading tool of claim 14, wherein the first section of said abrasive belt located between the first end of said block and said tension adjuster and a second section of said abrasive belt located between the second end of said block and said tension adjuster are aslant with respect to the first surface of said block.

* * * * *